US009341965B2

(12) United States Patent
Nishida et al.

(10) Patent No.: US 9,341,965 B2
(45) Date of Patent: May 17, 2016

(54) ELECTROPHOTOGRAPHIC PHOTOSENSITIVE MEMBER, METHOD FOR MANUFACTURING THE SAME, ELECTROPHOTOGRAPHIC APPARATUS, PROCESS CARTRIDGE, AND HYDROXYGALLIUM PHTHALOCYANINE CRYSTAL

(71) Applicant: CANON KABUSHIKI KAISHA, Tokyo (JP)

(72) Inventors: Tsutomu Nishida, Mishima (JP); Masato Tanaka, Tagata-gun (JP); Masataka Kawahara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/551,448

(22) Filed: Nov. 24, 2014

(65) Prior Publication Data

US 2015/0147691 A1 May 28, 2015

(30) Foreign Application Priority Data

Nov. 25, 2013 (JP) ..... 2013-243083

(51) Int. Cl.
*G03G 5/06* (2006.01)

(52) U.S. Cl.
CPC ..... *G03G 5/0696* (2013.01)

(58) Field of Classification Search
CPC ..... G03G 5/0696
See application file for complete search history.

(56) References Cited

U.S. PATENT DOCUMENTS

2009/0068576 A1* 3/2009 Hongo ..... C09B 47/10 430/57.1

FOREIGN PATENT DOCUMENTS

JP 05-249716 A 9/1993
JP 2005-290365 A 10/2005

* cited by examiner

*Primary Examiner* — Hoa V Le
(74) *Attorney, Agent, or Firm* — Canon U.S.A., Inc. IP Division

(57) ABSTRACT

A photosensitive layer of an electrophotographic photosensitive member contains a hydroxygallium phthalocyanine crystal of a crystalline form having peaks at Bragg angles 2θ±0.2° of 7.0°, 16.6°, 20.8°, and 26.9° in X-ray diffraction with CuKα radiation.

15 Claims, 3 Drawing Sheets

ELECTROPHOTOGRAPHIC PHOTOSENSITIVE MEMBER, METHOD FOR MANUFACTURING THE SAME, ELECTROPHOTOGRAPHIC APPARATUS, PROCESS CARTRIDGE, AND HYDROXYGALLIUM PHTHALOCYANINE CRYSTAL

BACKGROUND OF THE INVENTION

1. Field of the Invention

The present invention relates to an electrophotographic photosensitive member, a method for manufacturing the same, an electrophotographic apparatus and a process cartridge having the electrophotographic photosensitive member, and a hydroxygallium phthalocyanine crystal.

2. Description of the Related Art

As a charge generation material for use in the electrophotographic photosensitive member, a phthalocyanine pigment having high sensitivity is used.

However, while the electrophotographic photosensitive member containing the phthalocyanine pigment has an excellent sensitivity characteristic, a photomemory effect is likely to occur due to stray light coming from the outside of the process cartridge or the electrophotographic apparatus, and thus the improvement thereof has been demanded in recent years. The photomemory effect is a phenomenon caused by carriers that stay in a portion irradiated with light (irradiated portion), and thus arise a potential difference between the irradiated portion and a portion which is not irradiated with light (non-irradiated portion). As a result, the phenomenon causes a reduction in image quality (image reproducibility).

Japanese Patent Laid-Open No. 5-249716 describes that, by the use of a hydroxygallium phthalocyanine crystal for an electrophotographic photosensitive member, the electrophotographic photosensitive member exhibits high sensitivity to near-infrared light from a semiconductor laser and excellent stability when repeatedly used. Moreover, Japanese Patent Laid-Open No. 2005-290365 describes a technique of providing an electrophotographic photosensitive member with high sensitivity and low environmental dependence by the use of a phthalocyanine composition containing two kinds of phthalocyanine compounds.

However, as a result of an examination of the present inventors, the photomemory effect has not been sufficiently suppressed by the techniques described in Japanese Patent Laid-Open Nos. 5-249716 and 2005-290365.

The present invention provides an electrophotographic photosensitive member which suppresses the photomemory effect, a method for manufacturing the same, an electrophotographic apparatus, and a process cartridge having the electrophotographic photosensitive member.

Furthermore, the present invention provides a novel hydroxygallium phthalocyanine crystal of a crystalline form having a specific peak at Bragg angle in CuKα characteristic X-ray diffraction.

SUMMARY OF THE INVENTION

The present invention relates to an electrophotographic photosensitive member having a support and a photosensitive layer formed on the support, in which the photosensitive layer contains a hydroxygallium phthalocyanine crystal of a crystalline form having peaks at Bragg angles 2θ±0.2° of 7.0°, 16.6°, 20.8°, and 26.9° in X-ray diffraction with CuKα radiation.

Moreover, the present invention relates to a process cartridge containing the electrophotographic photosensitive member and at least one device selected from the group consisting of a charging device, a developing device, a transfer device, and a cleaning device which are integrally supported, in which the process cartridge can be freely attached to and detached from a main body of an electrophotographic apparatus.

Moreover, the present invention is an electrophotographic apparatus having the electrophotographic photosensitive member, a charging device, an exposure device, a developing device, and a transfer device.

Moreover, the present invention relates to a hydroxygallium phthalocyanine crystal of a crystalline form having peaks at Bragg angles 2θ±0.2° of 7.0°, 16.6°, 20.8°, and 26.9° in X-ray diffraction with CuKα radiation.

The present invention can provide an electrophotographic photosensitive member which suppresses the photomemory effect, a method for manufacturing the same, and an electrophotographic apparatus and a process cartridge having the electrophotographic photosensitive member.

Furthermore, the present invention can provide a novel hydroxygallium phthalocyanine crystal of a crystalline form having a specific peak at a Bragg angle of CuKα characteristic X-ray diffraction.

Further features of the present invention will become apparent from the following description of exemplary embodiments with reference to the attached drawings.

DESCRIPTION OF THE EMBODIMENTS

Figure 1:
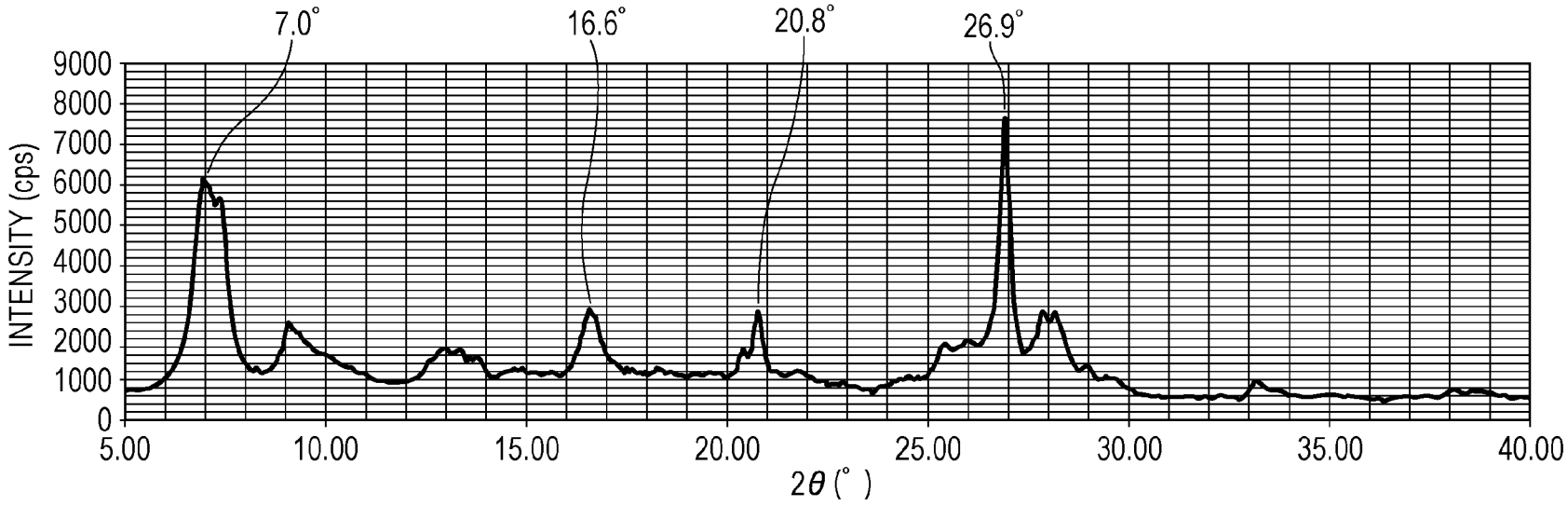
FIG. 1 is an X-ray diffraction profile of a hydroxygallium phthalocyanine crystal obtained in Crystal manufacturing example 1.

The present invention contains a hydroxygallium phthalocyanine crystal of a crystalline form having peaks (hereinafter also referred to as strong peaks) at Bragg angles 2θ±0.2° of 7.0°, 16.6°, 20.8°, and 26.9° in X-ray diffraction with CuKα radiation in the photosensitive layer of the electrophotographic photosensitive member.

The present inventors have found that when the novel hydroxygallium phthalocyanine crystal is compounded in the photosensitive layer, the photomemory effect can be reduced.

It is known that phthalocyanine is likely to form H-aggregates due to strong π-π stacking resulting from a large conjugated system. Then, when phthalocyanine forms H-aggregates, charge transfer is easily suppressed.

It is assumed that, in the hydroxygallium phthalocyanine crystal of the present invention, the H-aggregates are formed in a proper shape in the crystal in such a manner as to easily pass staying charges (carriers). Thus, it is considered that the staying of the carriers in a portion which is irradiated with light (irradiated portion) is suppressed and a potential difference between the irradiated portion and a portion which is not irradiated with light (non-irradiated portion) decreases, so that the photomemory effect is reduced.

The hydroxygallium phthalocyanine crystal of the present invention desirably contains hexamethylphosphoric acid triamide in the crystal.

The content of the hexamethylphosphoric acid triamide in the hydroxygallium phthalocyanine crystal is preferably 0.5% by mass or more and 20% by mass or less. The content is more preferably 5% by mass or more and 15% by mass or less.

Thus, it is assumed that when the hexamethylphosphoric acid triamide is contained in the crystal of the hydroxygallium phthalocyanine crystal of the present invention, a crystal structure which more efficiently passes the staying carriers is easily formed, so that the photomemory effect is reduced.

The hydroxygallium phthalocyanine crystal containing the hexamethylphosphoric acid triamide in a crystalline form has peaks (strong peaks) at Bragg angles 2θ±0.2° of 7.0°, 16.6°, 20.8°, and 26.9° in X-ray diffraction with CuKα radiation. Furthermore, a hydroxygallium phthalocyanine crystal of a crystalline form having a peak (strong peak) at 7.4° is also desirable.

The photosensitive layer containing the hydroxygallium phthalocyanine crystal of the present invention can be formed as follows.

The crystal transformation is performed by mixing a hydroxygallium phthalocyanine crystal of a crystalline form having strong peaks at Bragg angles 2θ±0.2° of 6.9° and 26.6° in X-ray diffraction with CuKα radiation and hexamethylphosphoric acid triamide. Thus, the hydroxygallium phthalocyanine crystal of a crystalline form having strong peaks at Bragg angles 2θ±0.2° of 7.0°, 16.6°, 20.8°, and 26.9° in X-ray diffraction with CuKα radiation can be obtained. Next, the hydroxygallium phthalocyanine crystal after the crystal transformation and a binder resin are mixed in a solvent to prepare a coating liquid for photosensitive layer. Then, a coating film of the coating liquid for photosensitive layer is formed, and then the coating film is dried to thereby form a photosensitive layer.

The hydroxygallium phthalocyanine crystal of a crystalline form having strong peaks at Bragg angles 2θ±0.2° of 6.9° and 26.6° in X-ray diffraction with CuKα radiation is obtained as follows. More specifically, by subjecting a chlorogallium phthalocyanine crystal to acid pasting treatment, the hydroxygallium phthalocyanine crystal of a crystalline form having strong peaks at Bragg angles 2θ±0.2° of 6.9° and 26.6° in X-ray diffraction with CuKα radiation is obtained. The acid pasting treatment is described below. More specifically, the treatment includes dissolving or dispersing phthalocyanine in acid, pouring the obtained solution or dispersion into a large amount of water, mixing a reprecipitated phthalocyanine solid with an aqueous alkaline solution as required, and then repeating washing with ion exchange water until the conductivity of the washing liquid reaches 20 μS or less. Examples of the acid for use in the acid pasting treatment include sulfuric acid, hydrochloric acid, and trifluoroacetic acid, for example. Among the above, strong sulfuric acid is desirable. The use amount of the acid is preferably 10 to 40 times that of the phthalocyanine pigment based on mass. The dissolution temperature or the dispersion temperature in the acid is preferably 50° C. or less from the viewpoint of decomposition of the phthalocyanine pigment or a reaction with the acid.

In order to judge whether the hydroxygallium phthalocyanine crystal contains the hexamethylphosphoric acid triamide in the crystal, the NMR measurement data of the obtained hydroxygallium phthalocyanine crystal are analyzed in the present invention. When the hexamethylphosphoric acid triamide is detected from the obtained hydroxygallium phthalocyanine crystal, it can be judged that the hexamethylphosphoric acid triamide is contained in the crystal. Specifically, the hydroxygallium phthalocyanine crystal is dissolved in a solvent, and then the H-NMR measurement is performed. From the integration value of the peak obtained by the H-NMR measurement, the molar composition ratio between the hydroxygallium phthalocyanine and the hexamethylphosphoric acid triamide is determined. Then, the mass ratio between the hydroxygallium phthalocyanine and the hexamethylphosphoric acid triamide is determined from the molecular weights, respectively.

The measurement of the X-ray diffraction and the measurement of the NMR of the hydroxygallium phthalocyanine crystal of the present invention are performed under the following conditions.

Powder X-Ray Diffraction Measurement

Used measurement machine: Manufactured by Rigaku Corporation, X-ray diffraction apparatus RINT-TTRII X-ray tube: Cu
Tube voltage: 50 kV
Tube current: 300 mA
Scanning method: 2θ/θ scanning
Scanning speed: 4.0°/min
Sampling interval: 0.02°
Start angle (2θ): 5.0°
Stop angle (2θ): 40.0°
Attachment: Standard sample holder
Filter: Not-used
Incident monochromator: Used
Counter monochromator: Not-used
Divergence slit: Open
Divergence vertical limitation slit: 10.00 mm
Scattering slit: Open
Light receiving slit: Open
Counter: Scintillation counter H-NMR measurement Used measuring instrument: (JMN-EX400, Product of JEOL)

Solvent: Bisulfate ($D_2SO_4$)

The electrophotographic photosensitive member of the present invention has a support and a photosensitive layer.

Examples of the photosensitive layer include a monolayer type photosensitive layer containing a charge transport material and a charge generation material in the same layer and a multi-layer type (function separation type) photosensitive layer in which a charge generation layer containing a charge generation material and a charge transport layer containing a charge transport material are separated. From the viewpoint of the electrophotographic characteristics, the multi-layer type photosensitive layer having the charge generation layer and the charge transport layer formed on the charge generation layer is desirable.

Figure 4A:
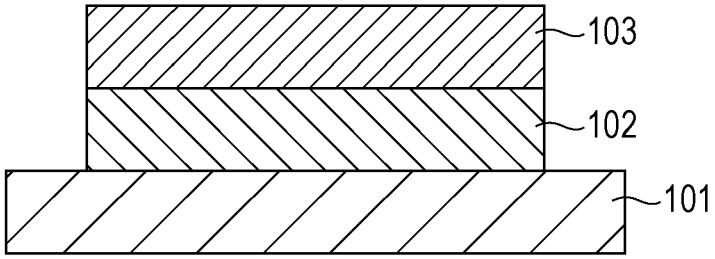
FIG. 4A and FIG. 4B are views describing the layer configuration of the electrophotographic photosensitive member.
Figure 4B:
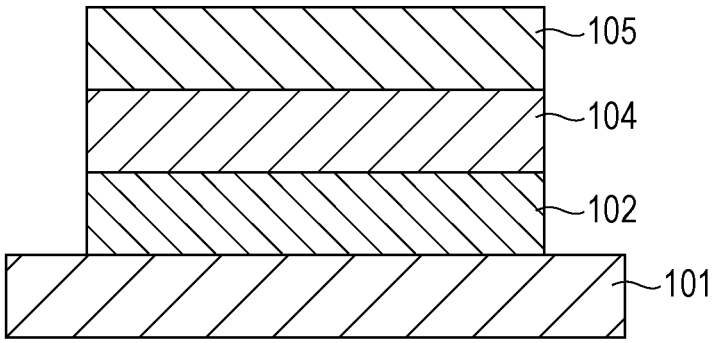

FIG. 4A and FIG. 4B are views illustrating one example of the layer configuration of the electrophotographic photosensitive member of the present invention. In FIG. 4A, the electrophotographic photosensitive member has a support 101, an undercoat layer 102, and a photosensitive layer 103. In FIG. 4B, the electrophotographic photosensitive member has a support 101, an undercoat layer 102, a charge generation layer 104, and a charge transport layer 105.

Support

The support is desirably one having conductivity (conductive support). For example, a support containing metal or alloy, such as aluminum or stainless steel, is mentioned. Moreover, a support containing metal, plastic, or paper having a conductive coating film on the surface is mentioned.

Examples of the shape of the support include a cylindrical shape and a film shape, for example.

Between the support and the undercoat layer described later, a conductive layer may be provided for the purpose of concealing the unevenness and suppressing interference fringes on the surface of the support. The conductive layer can be formed by forming a coating film of a coating liquid for conductive layer obtained by dispersing conductive particles, a binder resin, and a solvent, and then drying/curing the coating film.

Examples of the conductive particles include aluminum particles, titanium oxide particles, tin oxide particles, zinc oxide particles, carbon black, and silver particles, for example. Examples of the binder resin include polyester, polycarbonate, polyvinyl butyral, acrylic resin, silicone resine, epoxy resin, melamine resin, urethane resin, phenol resin, and alkyd resin, for example. Examples of the solvent of the coating liquid for conductive layer include an ether solvent, an alcohol solvent, a ketone solvent, and an aromatic hydrocarbon solvent, for example.

The film thickness of the conductive layer is preferably 5 to 40 μm and more preferably 10 to 30 μm.

Between the support and the photosensitive layer, an undercoat layer (also referred to as "intermediate layer") having a barrier function or an adhesion function can also be provided. The undercoat layer can be formed by forming a coating film of a coating liquid for undercoat layer prepared by mixing a binder resin and a solvent, and then drying the coating film.

Examples of the binder resin for use in the undercoat layer include polyvinyl alcohol, polyethylene oxide, ethyl cellulose, methyl cellulose, casein, and polyamide, for example. The film thickness of the undercoat layer is preferably 0.3 to 5.0 μm.

Photosensitive Layer, Charge Generation Layer

When the photosensitive layer is the multi-layer type photosensitive layer, the charge generation layer contains the hydroxygallium phthalocyanine crystal of the present invention as the charge generation material. The charge generation layer can be formed by forming a coating film of a coating liquid for charge generation layer prepared by dispersing the hydroxygallium phthalocyanine crystal and a binder resin in a solvent, and then drying the coating film.

The film thickness of the charge generation layer is preferably 0.05 to 1 μm and more preferably 0.1 to 0.3 μm.

The content of the charge generation material in the charge generation layer is preferably 30 to 90% by mass and more preferably 50 to 80% by mass based on the total mass of the charge generation layer.

Examples of the charge generation material for use in the charge generation layer include the hydroxygallium phthalocyanine crystal of a crystalline form having strong peaks at Bragg angles 2θ±0.2° of 7.0°, 16.6°, 20.8°, and 26.9° in X-ray diffraction with CuKα radiation. As the charge generation material, those other than the hydroxygallium phthalocyanine crystal may be used. In this case, the proportion of the hydroxygallium phthalocyanine crystal of the present invention is preferably 50% by mass or more based on the total mass of the charge generation material.

Examples of the binder resin for use in the charge generation layer include polyester, acrylic resin, phenoxy resin, polycarbonate, polyvinyl butyral, polystyrene, polyvinyl acetate, polysulphone, polyarylate, vinylidene chloride, an acrylonitrile copolymer, and polyvinyl benzal, for example. Among the above, polyvinyl butyral and polyvinyl benzal are desirable.

Photosensitive Layer, Charge Transport Layer

The charge transport layer can be formed by forming a coating film of a coating liquid for charge transport layer prepared by dissolving a charge transport material and a binder resin in a solvent, and then drying the coating film.

Examples of the charge transport material include a triarylamine compound, a hydrazone compound, a stilbene compound, a pyrazoline compound, an oxazole compound, a thiazole compound, and a triallylmethane compound, for example. Among the above, the triarylamine compound is desirable.

Examples of the binder resin for use in the charge transport layer include polyester, acrylic resin, phenoxy resin, polycarbonate, polystyrene, polyvinyl acetate, polysulphone, polyarylate, vinylidene chloride, and an acrylonitrile copolymer, for example. Among the above, the polycarbonate and the polyarylate are desirable.

The film thickness of the charge transport layer is preferably 5 to 40 μm and more preferably 10 to 25 μm. The content of the charge transport material in the charge transport layer is preferably 20 to 80% by mass and more preferably 30 to 60% by mass based on the total mass of the charge transport layer.

When the photosensitive layer is a monolayer type photosensitive layer, the photosensitive layer can be formed by forming a coating film of a coating liquid for monolayer type photosensitive layer, and then drying the coating film. The coating liquid for monolayer type photosensitive layer can be prepared by mixing the hydroxy phthalocyanine crystal of the present invention as the charge generation material, a charge transport material, a binder resin, and a solvent.

On the photosensitive layer, a protective layer may be provided for the purpose of protecting the photosensitive layer.

The protective layer can be formed by forming a coating film of a coating liquid for protective layer prepared by dissolving a binder resin in a solvent, and then drying the coating film. Examples of the binder resin for use in the protective layer include polyvinyl butyral, polyester, polycarbonate, nylon, polyimide, polyarylate, polyurethane, a styrene-butadiene copolymer, a styrene-acrylic acid copolymer, and a styrene-acrylonitrile copolymer, for example.

In order to impart charge transportability to the protective layer, the protective layer may also be formed by curing monomers having charge transportability (hole transportability) using various polymerization reactions and crosslinking reactions. Specifically, the protective layer is desirably formed by polymerizing or crosslinking charge transportable compounds (hole transportable compounds) having a chain polymerizable functional group, and then curing the same.

The film thickness of the protective layer is preferably 0.05 to 20 μm.

Examples of a method for applying the coating liquid for each layer include a dip coating method (a dipping method), a spray coating method, a spinner coating method, a bead coating method, a blade coating method, and a beam coating method, for example.

In the layer serving as the surface layer of the electrophotographic photosensitive member, conductive particles, an ultraviolet absorber, and lubricating particles, such as fluorine atom containing resin particles, may be compounded. Examples of the conductive particles include metal oxide particles, such as tin oxide particles, for example.

Figure 3:
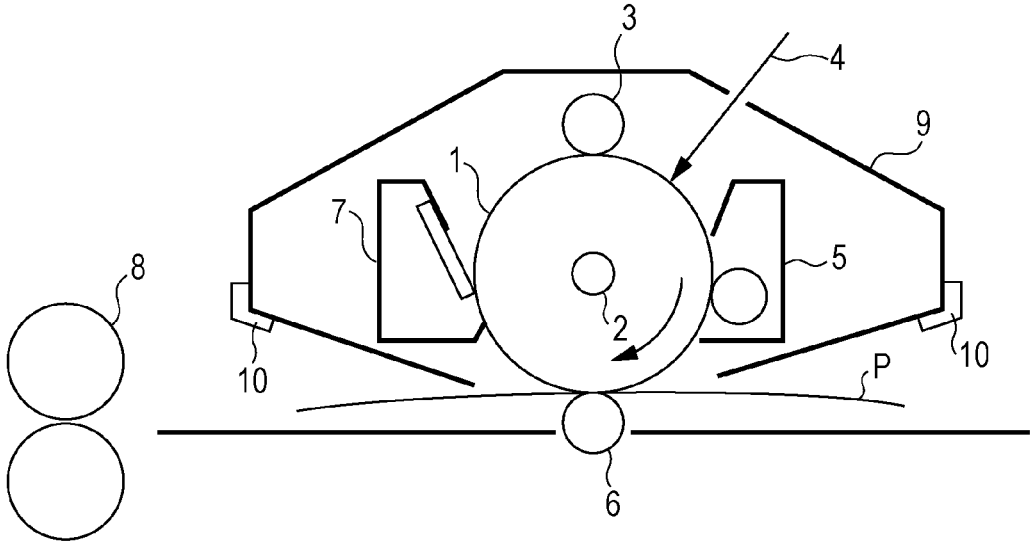
FIG. 3 is an example of the schematic configuration of an electrophotographic apparatus having a process cartridge having an electrophotographic photosensitive member.

FIG. 3 is a view illustrating one example of the schematic configuration of an electrophotographic apparatus having a process cartridge having the electrophotographic photosensitive member.

A cylindrical (drum shape) electrophotographic photosensitive member 1 is driven and rotated at a predetermined circumferential velocity (process speed) in the direction indicated by the arrow around a shaft 2.

In the rotation process, the surface (circumferential surface) of the electrophotographic photosensitive member 1 is charged with a predetermined positive or negative potential by a charging device (primary charging device) 3. Subsequently, the surface of the electrophotographic photosensitive member 1 is irradiated with an exposure light (image exposure light) 4 from an exposure device (image exposure device) (not illustrated), and then an electrostatic latent image corresponding to the target image information is formed on the surface of the electrophotographic photosensitive member 1. The exposure light 4 is light which is emitted from the exposure device, such as a slit exposure and a laser beam scanning exposure, and whose intensity is modulated corresponding to a time-sequence electric digital pixel signal of the target image information, for example.

The electrostatic latent image formed on the surface of the electrophotographic photosensitive member 1 is developed (normal development or reversal development) by a developing agent (toner) stored in a developing device 5, and then a toner image is formed on the surface of the electrophotographic photosensitive member 1. The toner image formed on the surface of the electrophotographic photosensitive member 1 is transferred to a transfer material P by a transfer device 6. In this process, a voltage (transfer bias) having a polarity opposite to the polarity of the possessed charges of the toner is applied to the transfer device 6 from a bias power supply (not illustrated). The transfer material P is taken out from a transfer material supply device (not illustrated) synchronizing with the rotation of the electrophotographic photosensitive member 1, and is fed between the electrophotographic photosensitive member 1 and the transfer device 6.

The transfer material P to which the toner image is transferred is separated from the surface of the electrophotographic photosensitive member 1, conveyed to a fixing device 8, subjected to fixing treatment of the toner image, and then printed out to the outside of the electrophotographic apparatus as image formed matter (print, copy).

The surface of the electrophotographic photosensitive member 1 after the toner image is transferred to the transfer material P is subjected to the removal of adherents, such as an untransferred developing agent (untransferred toner), by a cleaning device 7 to be cleaned. The untransferred toner can also be collected by the developing device or the like (cleanerless system).

Furthermore, the surface of the electrophotographic photosensitive member 1 is irradiated with a pre-exposure light (not illustrated) from a pre-exposure device (not illustrated), repeatedly subjected to static elimination treatment, and then repeatedly used for image formation. As illustrated in FIG. 3, when the charging device 3 is a contact charging device employing a charging roller, the pre-exposure device is not always required.

A plurality of components among the components, such as the electrophotographic photosensitive member 1, the charging device 3, the developing device 5, and the cleaning device 7, may be stored in a container and integrally supported to form a process cartridge. The process cartridge can be configured to be freely attached to and detached from a main body of the electrophotographic apparatus. For example, at least one device selected from the charging device 3, the developing device 5, and the cleaning device 7 is integrally supported with the electrophotographic photosensitive member 1 to form a cartridge. Then, the use of a guide device 10, such as a rail of the main body of the electrophotographic apparatus, allows the formation of a process cartridge 9 which can be freely attached to and detached from the main body of the electrophotographic apparatus body.

When the electrophotographic apparatus is a copying machine or a printer, the exposure light 4 may be reflected light or penetration light from an original. The exposure light 4 may be light emitted from a laser device, an LED array or a liquid crystal shutter array during scanning or driving operation that is performed in response to signals obtained by reading an original with a sensor and then converted to the signals.

In the present invention, examples of the novel hydroxygallium phthalocyanine crystal is a hydroxygallium phthalocyanine crystal of a crystalline form having strong peaks at Bragg angles 2θ±0.2° of 7.0°, 16.6°, 20.8°, and 26.9° in X-ray diffraction with CuKα radiation.

The hydroxygallium phthalocyanine crystal desirably contains hexamethylphosphoric acid triamide in the crystal. The content of the hexamethylphosphoric acid triamide in the hydroxygallium phthalocyanine crystal is desirably 0.5% by mass or more and 20% by mass or less.

EXAMPLES

Hereinafter, the present invention is described in more detail with reference to specific examples. However, the present invention is not limited thereto. The film thickness of each layer of electrophotographic photosensitive members of Examples and Comparative Examples is determined by an eddy current film thickness meter (FISCHERSCOPE, manufactured by Fischer Instrument, Inc.) or from the mass per unit area in terms of specific gravity. In the following description, "part(s)" means "part(s) by mass" and "%" means "% by mass."

Crystal Manufacturing Example 1

As acid pasting treatment, 15 parts of chlorogallium phthalocyanine crystal was dissolved in 450 parts of 10° C. concentrated sulfuric acid, stirred for 1 hour, added dropwise into 2300 parts of ice water, re-precipitated, and then filtered. Then, the residue on a filter paper was dispersed and washed with 2% ammonia water, washed with ion exchange water, and then dried. Thus, 13 parts of hydroxygallium phthalocyanine crystal of a crystalline form having peaks at Bragg angles 2θ±0.2° of 6.9° and 26.6° in X-ray diffraction with CuKα radiation was obtained.

Next, 10 parts of the obtained hydroxygallium phthalocyanine crystal was subjected to milling treatment using 200 parts of hexamethylphosphoric acid triamide and 300 parts of glass beads having a diameter of 1 mm to undergo a crystal transformation process. The resultant substance was filtered, washed with THF (tetrahydrofuran), and then dried to obtain a hydroxygallium phthalocyanine crystal.

The obtained hydroxygallium phthalocyanine crystal had a crystalline form having peaks at Bragg angles 2θ±0.2° of 7.0°, 16.6°, 20.8°, and 26.9° in X-ray diffraction with CuKα radiation. The X-ray diffraction diagram thereof is shown in FIG. 1.

Separately, the obtained hydroxygallium phthalocyanine crystal was dissolved in a sulfuric acid-d2 solution (manufactured by Sigma-Aldrich). The solution was subjected to $^{1}$H-NMR spectrum measurement using a nuclear magnetic resonance apparatus.

The measurement results are shown below.

$^1$H-NMR (ppm, D2SO4): δ=

9.52 (s, 8H) Derived from hydroxygallium phthalocyanine 8.42 (s, 8H) Derived from hydroxygallium phthalocyanine 2.65 (d, 6H) Derived from hexamethylphosphoric acid triamide As a result of conversion based on the proton ratio, the ratio of the hexamethylphosphoric acid triamide in the hydroxygallium phthalocyanine crystal was 10.1% (mass ratio).

Crystal Manufacturing Example 2

A hydroxygallium phthalocyanine crystal was manufactured in the same manner as in Crystal manufacturing example 1, except changing to 180 parts of hexamethylphosphoric acid triamide and 250 parts of glass beads having a diameter of 1 mm in Crystal manufacturing example 1.

The obtained hydroxygallium phthalocyanine crystal had a crystalline form having peaks at Bragg angles 2θ±0.2° of 6.9°, 16.6°, 20.8°, and 26.9° in X-ray diffraction with CuKα radiation. The ratio of the hexamethylphosphoric acid triamide in the hydroxygallium phthalocyanine crystal was 5.2% (mass ratio).

Crystal Manufacturing Example 3

A hydroxygallium phthalocyanine crystal was manufactured in the same manner as in Crystal manufacturing example 1, except changing to 230 parts of hexamethylphosphoric acid triamide and 320 parts of glass beads having a diameter of 1 mm in Crystal manufacturing example 1.

The obtained hydroxygallium phthalocyanine crystal had a crystalline form having peaks at Bragg angles 2θ±0.2° of 7.0°, 16.5°, 20.8°, and 26.9° in X-ray diffraction with CuKα radiation. The ratio of the hexamethylphosphoric acid triamide in the hydroxygallium phthalocyanine crystal was 14.9% (mass ratio).

Crystal Manufacturing Example 4

A hydroxygallium phthalocyanine crystal was manufactured in the same manner as in Crystal manufacturing example 1, except changing to 100 parts of hexamethylphosphoric acid triamide and 200 parts of glass beads having a diameter of 1 mm in Crystal manufacturing example 1.

The obtained hydroxygallium phthalocyanine crystal had a crystalline form having peaks at Bragg angles 2θ±0.2° of 7.0°, 16.6°, 20.7°, and 26.9° in X-ray diffraction with CuKα radiation. The ratio of the hexamethylphosphoric acid triamide in the hydroxygallium phthalocyanine crystal was 0.5% (mass ratio).

Crystal Manufacturing Example 5

A hydroxygallium phthalocyanine crystal was manufactured in the same manner as in Crystal manufacturing example 1, except changing to 300 parts of hexamethylphosphoric acid triamide and 400 parts of glass beads having a diameter of 1 mm in Crystal manufacturing example 1.

The hydroxygallium phthalocyanine crystal thus obtained had a crystalline form having peaks at Bragg angles 2θ±0.2° of 7.0°, 16.6°, 20.8°, and 27.0° in X-ray diffraction with CuKα radiation. The ratio of the hexamethylphosphoric acid triamide in the hydroxygallium phthalocyanine crystal was 19.8% (mass ratio).

Crystal Manufacturing Example 6

As acid pasting treatment, 10 parts of chlorogallium phthalocyanine crystal was dissolved in 250 parts of concentrated sulfuric acid, stirred for 2 hours, and then added dropwise into a mixed solution of 870 ml of ice-cooled ion exchange water and 530 ml of concentrated ammonia water to precipitate a crystal. The precipitated crystal was sufficiently washed with ion exchange water, and then dried, whereby 9 parts of hydroxygallium phthalocyanine crystal was obtained.

The obtained hydroxygallium phthalocyanine crystal had a crystalline form having peaks at Bragg angles 2θ±0.2° of 7.0°, 13.4°, 16.6°, 26.0°, and 26.7° in X-ray diffraction with CuKα radiation. Hexamethylphosphoric acid triamide was not contained in the obtained hydroxygallium phthalocyanine crystal.

Crystal Manufacturing Example 7

A hydroxygallium phthalocyanine crystal was manufactured in the same manner as in Crystal manufacturing example 1, except changing the hexamethylphosphoric acid triamide to tetrahydrofuran as a solvent for the crystal transformation process in Crystal manufacturing example 1. The obtained hydroxygallium phthalocyanine crystal had a crystalline form having peaks at Bragg angles 2θ±0.2° of 7.4°, 10.0°, 16.2°, 18.7°, 25.2°, and 28.4° in X-ray diffraction with CuKα. Hexamethylphosphoric acid triamide was not contained in the obtained hydroxygallium phthalocyanine crystal.

Crystal Manufacturing Example 8

A hydroxygallium phthalocyanine crystal was manufactured in the same manner as in Crystal manufacturing example 1, except changing the hexamethylphosphoric acid triamide to dimethyl sulfoxide as a solvent for the crystal transformation process in Crystal manufacturing example 1. The obtained hydroxygallium phthalocyanine crystal had a crystalline form having peaks at Bragg angles 2θ±0.2° of 7.4°, 9.9°, 16.2°, 18.6°, 25.0°, and 28.8° in X-ray diffraction with CuKα. Hexamethylphosphoric acid triamide was not contained in the obtained hydroxygallium phthalocyanine crystal.

Crystal Manufacturing Example 9

A hydroxygallium phthalocyanine crystal was manufactured in the same manner as in Crystal manufacturing example 1, except changing the hexamethylphosphoric acid triamide to 1-methyl-2-pyrolidone as a solvent for the crystal transformation process in Crystal manufacturing example 1. The obtained hydroxygallium phthalocyanine crystal had a crystalline form having peaks at Bragg angles 2θ±0.2° of 7.4°, 9.9°, 16.2°, 18.6°, 25.1°, and 28.3° in X-ray diffraction with CuKα. Hexamethylphosphoric acid triamide was not contained in the obtained hydroxygallium phthalocyanine crystal.

Example 1

An aluminum cylinder (JIS-A3003, aluminum alloy) having a diameter of 24 mm and a length of 257.5 mm was used as a cylindrical support (conductive support).

Next, 60 parts of barium sulfate particles coated with tin oxide (Trade name: Pastran PC1, manufactured by Mitsui Mining and Smelting Co., Ltd.), 15 parts of titanium oxide particles (Trade name: TITANIXJR, manufactured by TAYCA CORP.), 43 parts of a resol type phenol resin (Trade name: Phenolite J-325 manufactured by Dainippon Ink & Chemicals, Inc., Solid content of 70% by mass), 0.015 part of silicone oil (Trade name: SH28PA, manufactured by Toray Silicone Co., Ltd.), 3.6 parts of silicone resine particles (Trade name: Tospearl 120, manufactured by Toshiba Silicone Co., Ltd.), 50 parts of 2-methoxy-1-propanol, and 50 parts of methanol were put into a ball mill, and then dispersedly mixed for 20 hours to thereby prepare a coating liquid for conductive layer. The coating liquid for conductive layer was applied onto a support by dip coating to form a coating film, and then the coating film was cured by heating at a temperature of 140° C. for 1 hour to thereby form a conductive layer with a film thickness of 15 μm.

Next, 10 parts of copolymer nylon (Trade name: Amilan CM8000, manufactured by Toray Industries, Inc.) and 30 parts of methoxy methylated 6 nylon (Trade name: Toresin EF-30T, manufactured by TEIKOKU CHEM IND CORP LTD) were dissolved in a mixed solvent of 400 parts of methanol/200 parts of n-butanol to thereby prepare a coating liquid for undercoat layer. The coating liquid for undercoat layer was applied onto the conductive layer by dip coating to form a coating film, and then the coating film was dried at a temperature of 80° C. for 6 minutes to thereby form an undercoat layer having a film thickness of 0.45 μm.

Next, 10 parts of the hydroxygallium phthalocyanine crystal obtained in Crystal manufacturing example 1 (charge generation material), 5 parts of polyvinyl butyral (Trade name: Ethlec BX-1, manufactured by Sekisui Chemical Co., Ltd.), and 250 parts of cyclohexanone were put into a sand mill employing glass beads having a diameter of 1 mm, and then dispersedly mixed for 4 hours to prepare a dispersion liquid. Thereafter, 250 parts of ethyl acetate was added to the dispersion liquid to thereby prepare a coating liquid for charge generation layer. The coating liquid for charge generation layer was applied onto the undercoat layer by dip coating to form a coating film, and then the coating film was dried at a temperature of 100° C. for 10 minutes to thereby form a charge generation layer having a film thickness of 0.17 μm.

Next, 40 parts of a compound (hole transport material) represented by the following Formula (C-1), 40 parts of a compound represented by the following Formula (C-2) (hole transport material), (C-1)

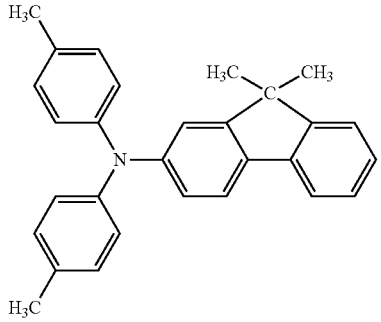

-continued (C-2)

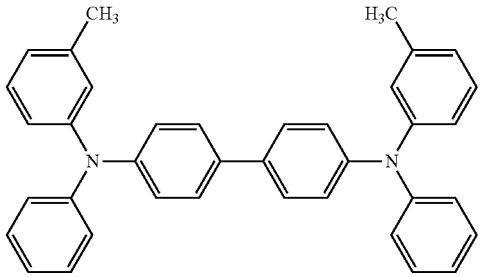

and 100 parts of polycarbonate (Trade name: Iupilon 2200, manufactured by Mitsubishi Engineering Plastics) were dissolved in a mixed solvent of 600 parts of monochlorobenzene/200 parts of dimethoxy methane to thereby prepare a coating liquid for charge transport layer. The coating liquid for charge transport layer was applied onto the charge generation layer by dip coating to form a coating film, the coating film was allowed to stand as it was for 10 minutes, and then the coating film was dried at a temperature of 120° C. for 30 minutes to thereby form a charge transport layer having a film thickness of 21 μm.

Thus, a cylindrical electrophotographic photosensitive member having the support, the conductive layer, the undercoat layer, the charge generation layer, and the charge transport layer was manufactured.

Figure 2:
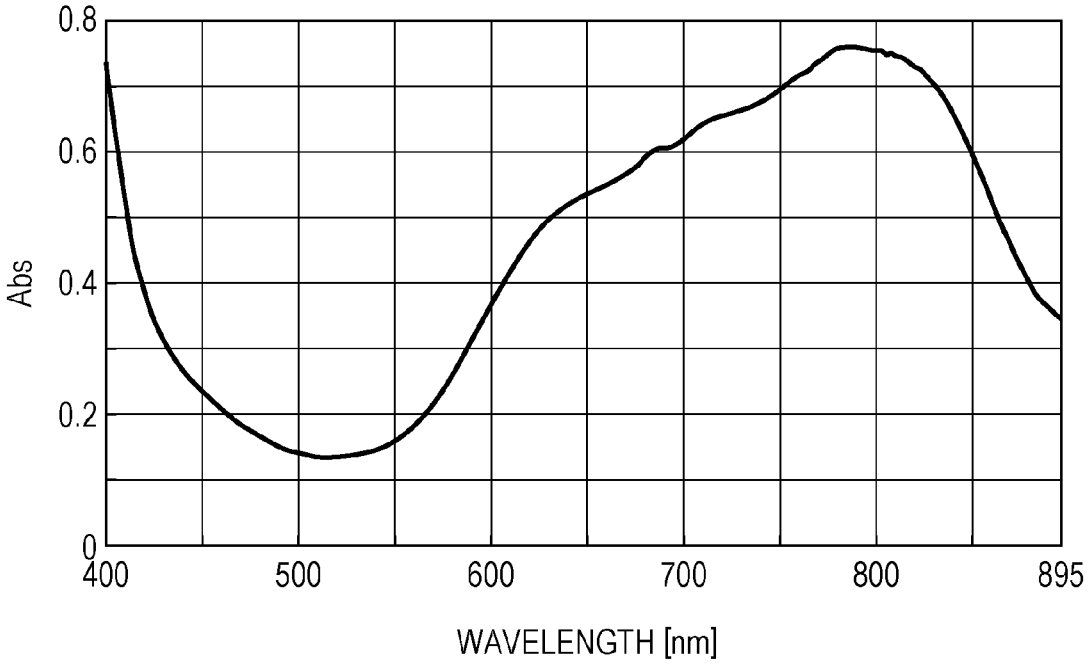
FIG. 2 is a UV absorption-spectrum of a charge generation layer obtained in Example 1.

The UV absorption spectrum of the charge generation layer is shown in FIG. 2. For the measurement, the coating liquid for charge generation layer was applied to a polyester film (Trade name Lumirror #100T60, manufactured by Toray Industries, Inc.) to form a coating film, and then the coating film was dried at a temperature of 100° C. for 10 minutes to thereby form a charge generation layer having a film thickness of 0.14 μm. The polyester film having the charge generation layer was set in a spectrum photometer (Trade name: V-570, manufactured by Jasco Corp.), and then the UV absorption spectrum was measured.

Examples 2 to 5

Electrophotographic photosensitive members of Examples 2 to 5 were manufactured in the same manner as in Example 1, except changing the hydroxygallium phthalocyanine crystal obtained in Crystal manufacturing example 1 to the hydroxygallium phthalocyanine crystals obtained in Crystal manufacturing examples 2 to 5, respectively, in Example 1.

Comparative Examples 1 to 4

Electrophotographic photosensitive members of Comparative Examples 1 to 4 were manufactured in the same manner as in Example 1, except changing the hydroxygallium phthalocyanine crystal obtained in Crystal manufacturing example 1 to the hydroxygallium phthalocyanine crystals obtained in Crystal manufacturing examples 6 to 9, respectively, in Example 1.

In Comparative Example 1, when the UV absorption spectrum of the charge generation layer was measured in the same manner as in Example 1, the UV absorption spectrum of the charge generation layer had a peak at 890 nm. Evaluation of electrophotographic photosensitive members of Examples 1 to 5 and Comparative Examples 1 to 4

As an electrophotographic apparatus for evaluation, a laser beam printer manufactured by Hewlett Packard Co. (Trade name: LaserJet Pro400Color M451dn) was modified as follows for use. More specifically, the laser power of the laser beam printer was modified to be 0.40 μJ/cm$^2$. Moreover, the produced electrophotographic photosensitive member was attached to a process cartridge for cyan color, and then the resultant substance was attached to the station of the process cartridge for cyan color.

As a method for evaluating the photomemory effect, the surface (circumferential surface) of the electrophotographic photosensitive member was partially shielded from light, and then a portion which was not shielded from light was irradiated with light of a 1500 lux white fluorescent light for 5 minutes. Then, charging and exposure were performed, and then a difference (potential difference) ΔV1(V) between the light area potential V1 of the irradiated portion and the light area potential V1 of a non-irradiated portion was evaluated as a value of the photomemory effect. The ΔV1 value indicates that when the value is smaller, the photomemory effect is further suppressed.

$$\Delta V1 = V1 \text{ of irradiated portion} - V1 \text{ of non-irradiated portion}$$

The results are shown in Table 1.

TABLE 1

| | Hydroxygallium phthalocyanine crystal | Bragg angle in X-ray diffraction with CuKα radiation | Content of hexamethylphosphoric acid triamide (% by mass) | Photomemory effect ΔVI (V) |
|---|---|---|---|---|
| Ex. 1 | Manufacturing Ex. 1 | 7.0°, 16.6°, 20.8°, 26.9° | 10.1 | 12 |
| Ex. 2 | Manufacturing Ex. 2 | 6.9°, 16.6°, 20.8°, 26.9° | 5.2 | 15 |
| Ex. 3 | Manufacturing Ex. 3 | 7.0°, 16.5°, 20.8°, 26.9° | 14.9 | 14 |
| Ex. 4 | Manufacturing Ex. 4 | 7.0°, 16.6°, 20.7°, 26.9° | 0.5 | 21 |
| Ex. 5 | Manufacturing Ex. 5 | 7.0°, 16.6°, 20.8°, 27.0° | 19.8 | 19 |
| Comp. Ex. 1 | Manufacturing Ex. 6 | 7.0°, 13.4°, 16.6°, 26.0°, 26.7° | 0 | 31 |
| Comp. Ex. 2 | Manufacturing Ex. 7 | 7.4°, 10.0°, 16.2°, 18.7°, 25.2°, 28.4° | 0 | 27 |
| Comp. Ex. 3 | Manufacturing Ex. 8 | 7.4°, 9.9°, 16.2°, 18.6°, 25.0°, 28.8° | 0 | 24 |
| Comp. Ex. 4 | Manufacturing Ex. 9 | 7.4°, 9.9°, 16.2°, 18.6°, 25.1°, 28.3° | 0 | 25 |

It is recognized from Table 1 that, in the electrophotographic photosensitive members of Examples 1 to 5, the photomemory effect is suppressed by 12.5% or more as compared with the electrophotographic photosensitive members of Comparative Examples 1 to 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-243083, filed Nov. 25, 2013, which is hereby incorporated by reference herein in its entirety.

What is claimed is:

1. An electrophotographic photosensitive member comprising:

a support; and a photosensitive layer formed on the support;

wherein the photosensitive layer comprises:

a hydroxygallium phthalocyanine crystal of a crystalline form having peaks at Bragg angles 2θ±0.2° of 7.0°, 16.6°, 20.8° and 26.9° in X-ray diffraction with CuKα radiation.

2. The electrophotographic photosensitive member according to claim 1, wherein the hydroxygallium phthalocyanine crystal comprises hexamethylphosphoric acid triamide in the crystal.

3. The electrophotographic photosensitive member according to claim 2, wherein a content of the hexamethylphosphoric acid triamide in the hydroxygallium phthalocyanine crystal is 0.5% by mass or more and 20% by mass or less.

4. The electrophotographic photosensitive member according to claim 1, wherein the photosensitive layer contains a binder resin.

5. A method for manufacturing an electrophotographic photosensitive member having a support and a photosensitive layer formed on the support, the method comprising:

mixing a hydroxygallium phthalocyanine crystal of a crystalline form having peaks at Bragg angles 2θ±0.2° of 6.9° and 26.6° in X-ray diffraction with CuKα radiation and hexamethylphosphoric acid triamide for crystal transformation to obtain a hydroxygallium phthalocyanine crystal of a crystalline form having peaks at Bragg angles 2θ±0.2° of 7.0°, 16.6°, 20.8°, and 26.9° in X-ray diffraction with CuKα radiation;

mixing the hydroxygallium phthalocyanine crystal after the crystal transformation and a binder resin in a solvent to prepare a coating liquid for photosensitive layer; and forming a coat of the coating liquid for photosensitive layer, and then drying the coat to form the photosensitive layer.

6. The method for manufacturing an electrophotographic photosensitive member according to claim 5, wherein the hydroxygallium phthalocyanine crystal of a crystalline form having peaks at Bragg angles 2θ±0.2° of 6.9° and 26.6° in X-ray diffraction with CuKα radiation is a hydroxygallium phthalocyanine crystal obtained by subjecting a chlorogallium phthalocyanine crystal treated with acid pasting.

7. The method for manufacturing an electrophotographic photosensitive member according to claim 5, wherein a content of the hexamethylphosphoric acid triamide in the hydroxygallium phthalocyanine crystal of a crystalline form having peaks at Bragg angles 2θ±0.2° of 7.0°, 16.6°, 20.8°, and 26.9° in X-ray diffraction with CuKα radiation is 0.5% by mass or more and 20% by mass or less.

8. A method for manufacturing an electrophotographic photosensitive member having a support, a charge generation layer formed on the support, and a charge transport layer formed on the charge generation layer, the method comprising:

mixing a hydroxygallium phthalocyanine crystal of a crystalline form having peaks at Bragg angles 2θ±0.2° of 6.9° and 26.6° in X-ray diffraction with CuKα radiation and hexamethylphosphoric acid triamide for crystal transformation to obtain a hydroxygallium phthalocyanine crystal of a crystalline form having peaks at Bragg angles 2θ±0.2° of 7.0°, 16.6°, 20.8°, and 26.9° in X-ray diffraction with CuKα radiation;

mixing the hydroxygallium phthalocyanine crystal after the crystal transformation and a binder resin in a solvent to prepare a coating liquid for charge generation layer; and then forming a coat of the coating liquid for charge generation layer, and then drying the coat to form the charge generation layer.

9. The method for manufacturing an electrophotographic photosensitive member according to claim 8, wherein the hydroxygallium phthalocyanine crystal of a crystalline form having peaks at Bragg angles 2θ±0.2° of 6.9° and 26.6° in X-ray diffraction with CuKα radiation is a hydroxygallium phthalocyanine crystal obtained by subjecting a chlorogallium phthalocyanine crystal treated with acid pasting.

10. The method for manufacturing an electrophotographic photosensitive member according to claim 8, wherein a content of the hexamethylphosphoric acid triamide in the hydroxygallium phthalocyanine crystal of a crystalline form having peaks at Bragg angles 2θ±0.2° of 7.0°, 16.6°, 20.8°, and 26.9° in X-ray diffraction with CuKα radiation is 0.5% by mass or more and 20% by mass or less.

11. A process cartridge, comprising: the electrophotographic photosensitive member according to claim 1 and at least one device selected from the group consisting of a charging device, a developing device, a transfer device, and cleaning device which are integrally supported, wherein the process cartridge is freely attached to and detached from a main body of an electrophotographic apparatus.

12. An electrophotographic apparatus, comprising: the electrophotographic photosensitive member according to claim 1, a charging device, an exposure device, a developing device, and a transfer device.

13. A hydroxygallium phthalocyanine crystal of a crystalline form having peaks at Bragg angles 2θ±0.2° of 7.0°, 16.6°, 20.8°, and 26.9° in X-ray diffraction with CuKα radiation.

14. The hydroxygallium phthalocyanine crystal according to claim 13, wherein the hydroxygallium phthalocyanine comprises hexamethylphosphoric acid triamide in a crystal.

15. The hydroxygallium phthalocyanine crystal according to claim 13, wherein a content of the hexamethylphosphoric acid triamide in the hydroxygallium phthalocyanine crystal is 0.5% by mass or more and 20% by mass or less.

* * * * *